United States Patent [19]

Eckert et al.

[11] Patent Number: 4,793,971

[45] **Date of Patent: * Dec. 27, 1988**

[54] GRAIN REFINING

[75] Inventors: Charles E. Eckert, Plum Boro; Elwin L. Rooy, Franklin Park Boro, both of Pa.

[73] Assignee: Aluminum Company of America, Pittsburgh, Pa.

[ * ] Notice: The portion of the term of this patent subsequent to Aug. 25, 2004 has been disclaimed.

[21] Appl. No.: 89,217

[22] Filed: Aug. 25, 1987

Related U.S. Application Data

[63] Continuation-in-part of Ser. No. 812,982, Dec. 24, 1985, Pat. No. 4,689,199, which is a continuation of Ser. No. 654,736, Sep. 27, 1984, abandoned.

[51] Int. Cl.[4] ..... C22C 1/00

[52] U.S. Cl. ..... 420/590; 75/10.19

[58] Field of Search ..... 420/590, 129, 528; 75/10.19, 10.21, 10.46

[56] References Cited

U.S. PATENT DOCUMENTS

| | | | |
|---|---|---|---|
| 3,137,753 | 6/1964 | Feichtinger | 420/590 |
| 3,268,326 | 8/1966 | Harders | 420/590 |
| 3,340,020 | 9/1967 | Nevenschwarder et al. | 23/349 |
| 3,729,309 | 4/1973 | Kawawa | 75/129 |
| 3,768,999 | 10/1973 | Ohkubo et al. | 75/58 |
| 3,858,640 | 1/1975 | Sifferlen | 164/250 |
| 3,947,265 | 3/1976 | Guzowski et al. | 75/10 R |
| 4,688,771 | 8/1987 | Eckert et al. | 266/78 |
| 4,689,199 | 8/1987 | Eckert et al. | 420/590 |

FOREIGN PATENT DOCUMENTS

| | | | |
|---|---|---|---|
| 802133 | 12/1968 | Canada | 53/344 |

*Primary Examiner*—Christopher W. Brody
*Attorney, Agent, or Firm*—Carl R. Lippert

[57] ABSTRACT

A method for introducing grain refiners into molten media, such as molten aluminum, utilizes a chamber having a discharge immersed in the molten media and having a plasma therein extending from the molten media at the chamber discharge to a site above the discharge. Grain refiner is provided to said site and converted into a superheated spray for introduction into the media. An alternate embodiment includes supplying one or more constituents of a grain refiner compound to the plasma for reaction to form the grain refiner. A gas exits the chamber and enhances introduction into the media.

16 Claims, 2 Drawing Sheets

GRAIN REFINING

BACKGROUND OF THE INVENTION

This application is a continuation-in-part of U.S. Ser. No. 812,982 filed Dec. 24, 1985 now U.S. Pat. No. 4,689,199 which, in turn, was a continuation of U.S. Ser. No. 654,736, filed Sept. 27, 1984 now abandoned.

This invention relates to a method of adding grain refiners to molten media such as molten metals including aluminum. It further relates to reacting and forming grain refining compounds and introducing them into the media or reacting them in the media in situ.

Many different methods have been employed to add alloying elements to molten metals. Conventional methods typically add the elements directly to the melt in the form of a lump, a bar or the like. In some cases, they are added directly to molten metal being tapped into a ladle, and in other cases, they may be placed in the ladle prior to tapping.

Another method for adding alloying elements to molten metals, particularly molten steel, is disclosed in U.S. Pat. No. 3,768,999 to Ohkubo et al. In Ohkubo, alloying is accomplished by feeding a wire rod into the molten metal. The rod is coated with additives for the molten metal and an organic binder which decomposes into gaseous products in the molten metal. The generated gas stirs the molten metal and thus uniformly incorporates the added components throughout the molten metal.

U.S. Pat. No. 3,729,309 to Kawawa also discloses a method for adding alloying elements in the form of a wire rod to molten metals. The rod has a controlled size and is added to a molten metal bath by inserting it at a controlled speed, so as to produce a refined and purified metal alloy.

The above methods of adding alloying elements to molten metal work fairly well with alloying elements which dissolve, melt or disperse easily in the molten metal. However, such methods do not work as well with elements having limited liquid solubility such as Pb, Bi and Sn or readily high oxidized elements such as Mg and Zn.

U.S. Pat. No. 3947,265 to Guzowski et al proposes a solution to the problem of adding such "hard-to-alloy" materials to molten metal. The process employs a high current arc which is formed between the molten base metal and the alloying addition. The alloying addition is passed through the arc where it is melted and converted into a spray of finely divided superheated molten particles. In such a condition, the particles are able to rapidly dissolve in the molten metal upon contact therewith. While the Guzowski concept of alloying is certainly an interesting one, a need still exists for a process capable of providing improved results.

Accordingly, an object of the present invention is to provide an improved process for adding "hard-to-alloy" alloying materials to molten metals.

Another object of the present invention is to provide an alloying process having high dissolution rates.

Another object of the present invention is to provide an alloying process which is amenable to continuous casting processes.

Another object of the present invention is to provide a lead alloyed, aluminum based metal article having high machinability.

Another object of the present invention is to provide a process for adding alloying material to a molten media that additionally adds heat to the molten media.

Additional objects and advantages of the present invention will become apparent to persons skilled in the art from the following specification and drawings.

SUMMARY OF THE INVENTION

In accordance with the present invention, a method is provided for adding alloying material to a molten metal media, such as molten aluminum. The method includes the step of converting the alloying material into a spray of superheated alloy material and directing the spray into the molten metal media at a predetermined depth below the media's surface, the depth having been determined beforehand to enhance dissolution and dispersion of the alloying material into the molten media.

In a preferred embodiment, the alloying material is converted into the spray of superheated alloy material in a chamber or spark cup means which is at least partially immersed in the molten media body. The spark cup has a lower open end which is exposed to the molten media and an upper inlet, at least a portion of which is located above the exposed or exterior surface of the molten media. The lower open end of the spark cup is maintained or immersed a predetermined depth below the surface of the molten media. The alloying material, preferably in the form of an elongated element having a free end, is continually fed into the spark cup through its upper inlet, and an electrical arc discharge between the submerged molten metal surface and the alloying element in the spark cup is maintained with a current that exceeds the globular/spray transition current density of the alloying material. At such a current, the free or exposed end of the alloying element is converted into a spray of superheated material. An ionizable gas is continually supplied to the spark cup through its upper inlet also. In addition to shielding the arc discharge, the gas slightly pressurizes the spark cup and thereby prevents molten media from entering its open end. As such, a submerged interior surface of molten metal media is created in the spark cup's open end at the aforementioned predetermined depth. The shielding gas also carries or projects the superheated spray of alloy material into the molten media through the submerged molten metal surface so as to permit dissolution and dispersion of the alloy material in the media. The predetermined depth of immersion has been found to significantly enhance dispersion and dissolution of the alloying material into the media.

The present invention also provides a lead alloyed, aluminum based article having high machinability. The article is produced by converting lead alloy material into a spray of superheated alloy material which is injected into a bath of molten aluminum at a predetermined depth below the molten bath's surface. The spray is formed by establishing an electrical arc discharge between a submerged surface of the molten media and the alloying material. The discharge is maintained with a current that exceeds the globular/spray transition current density of the alloying material. The spray of superheated alloying material is directed onto the submerged interior surface of the media where dissolution and dispersion of the alloy material into the media take place. The submerged surface is maintained at the predetermined depth below the bath's surface having been found to enhance said dissolution and dispersion of the lead into molten aluminum bath. The article so produced has acicular shaped particles of lead which are smaller and more uniformly sized and dispersed than those which are made by adding lead at the surface of the molten aluminum or at a depth above the aforesaid predetermined depth.

DETAILED DESCRIPTION OF A PREFERRED EMBODIMENT

Figure 2:
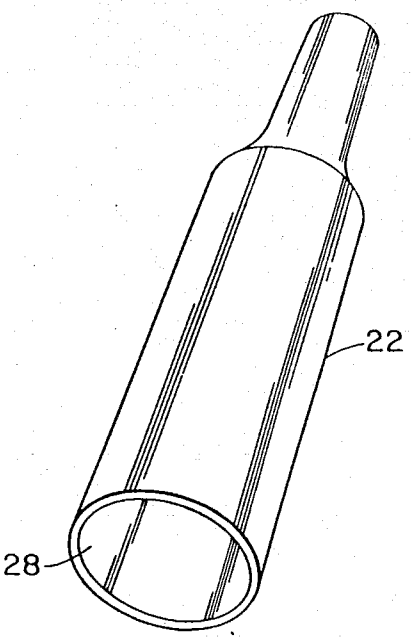
FIG. 2 illustrates the spark cup depicted in FIG. 1.
Figure 1:
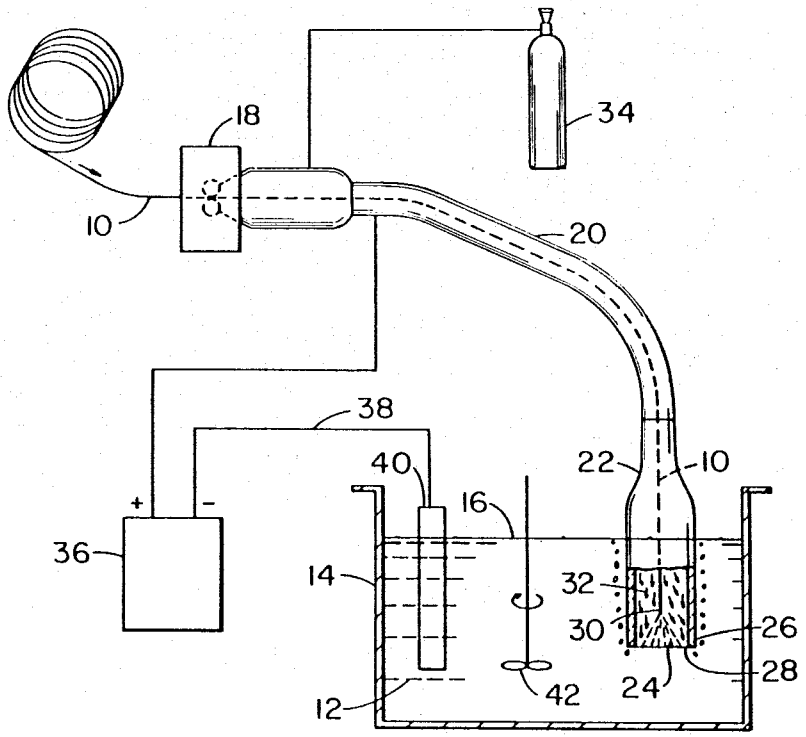
FIG. 1 illustrates an embodiment of the present invention.

FIG. 1 illustrates the addition of a wire 10 of alloying material into a bath or melt 12 of molten media in a flow-through furnace 14. The surface of melt 12 is referred to herein as exposed or exterior surface 16. Wire 10 is being fed by a feeder 18 which passes it through a triplex feed cable 20 into a spark cup 22, the spark cup being partially immersed in melt 12. In spark 22, alloy wire 10 is converted into a spray 24 of superheated alloy material by passing it through a plasma arc discharge (not numbered). The plasma arc discharge is established between a submerged surface 26 of the molten metal which is maintained within an open end 28 (see FIG. 2) of spark cup 22 and a free end 30 of alloy wire 10. The arc discharge is shielded with a shielding gas 32, preferably argon, which is provided via feed cable 20 by an arc shielding gas source 34. In addition to providing a shielding atmosphere for the arc in the spark cup, the shielding gas source 34 pressurizes the spark cup at a pressure which is sufficient to prevent molten metal from entering open end 28 of the spark cup. Such pressurization also facilitates maintenance of the aforementioned submerged surface at a certain predetermined depth below exposed surface 16 (more on this, infra). Returning to FIG. 1, it will be seen that the arc discharge is powered by a constant current power supply source 36 (more on this, infra). Melt 12 serves as an anode with wire 10 serving as a consumable electrode. The electrical circuit leading back to current source 36 is completed by a return wire 38 which is attached to a rod 40 immersed in melt 12. The superheated spray produced by the arc discharge is directed or projected by the supply of shielding gas onto submerged surface 26 where the alloy material rapidly dissolves and disperses in melt 12. The gas is preferably supplied at a flow rate that maximizes the projection of the spray into the melt. An impeller 42 or agitating means is also provided to further enhance dispersion of the alloy material throughout the melt. Spray 24 can be maintained as long as is desired by continually advancing or feeding the alloying wire into the spark cup. Feeder 18 can also be controlled to maintain or vary the rate at which wire 10 is fed into the spark cup.

The alloying material can be provided in wire form, as described above, or in the form of rod, tube, strip or in powdered form wherein the powders are encased in a hollow tube made from a suitable metal which has been swaged or otherwise worked to reduce its diameter and compact the powdered material in the tube. The only real limitation on the form of the alloying is that it should have a form which permits it to be fed into the feed cable in a seal-tight fashion, thereby enabling the pressurized atmosphere in the spark cup to be maintained. If the pressurized atmosphere in the spark cup is not maintained, molten metal will, quite obviously, enter the spark cup through its open end 28, thereby raising submerged surface 26 to a depth above its predetermined depth. Such raising of submerged surface 26 will result in lower dissolution and dispersion rates. (The importance of maintaining submerged surface 26 at its predetermined depth will be discussed in more detail, infra.) While no means for sealing the wire is depicted in FIG. 1, those skilled in the art will be aware of numerous means having the capability of providing an effective seal. Such means could include elastomer and pneumatic seals. In addition, feeder 18 is preferably a consistent feed rate tractor drive.

Constant current source 36 is preferably of the type which maintains a relatively constant current regardless of voltage fluctuations. The arc produced thereby has self-stabilizing characteristics and is relatively insensitive to changes in arc length which might be caused by fluctuations in the submerged molten metal depth. It may also be desirable in certain situations to further enhance arc stability by seeding the plasma discharge with certain additives, such as alkali metals which are known to promote arc stability. Arc stability can also be enhanced by using various fluxes known to those skilled in the relevant art.

As mentioned in U.S. Pat. No. 3,947,265 to Guzowski, it may be desirable to add a high frequency, high voltage component to the arc which is particularly useful if AC current is used. This apparently reduces the tendency of the arc to extinguish every time the voltage passes through zero, increases the stability of the arc and makes initiation of the arc less difficult.

An important aspect of the present invention requires that the current supplied by power source 36 exceed the globular/spray transition current density of the alloyed material. As used herein, the globular/spray transition current density defines the boundary line separating the two different types of metal transfer that are capable of occurring in the plasma arc discharge. (As pointed out by Guzowski in U.S. Pat. No. 3,947,265, this transistion point can vary with such factors as alloy type, wire size and wire speed.) In cases with current densities below the transition point, alloy material being transferred through the arc detaches into large drops which dissolve and disperse slowly in the molten metal media. At current densities above the transition point, the transfer mechanism changes causing the alloy material to convert a fine spray of superheated alloy material. In this condition, the alloy material rapidly dissolves and disperses in the molten media upon contact with submerged surface 26.

Shielding gas 32 carrying or projecting spray 24 into the melt also typically enters the melt. This, however, should not introduce or cause any melt contamination since such gas simply escapes from the melt by bubbling through the melt to exterior surface 16. As previously mentioned, the preferred shielding gas is argon; however, other shielding gases, such as helium, carbon monoxide and carbon dioxide, may also be used in appropriate situations.

The spark cup is preferably cylindrically shaped. Such a shape provides a relatively high spark cup surface area to volume ratio which facilitates conductive heat transfer from the spark cup to the melt. It is important to facilitate such heat transfer to prevent the spark cup from overheating. Moreover, those skilled in the relevant art will appreciate that such heat transfer to the melt is advantageous in that it provides a convenient way of adding heat to the melt, thereby reducing furnace fuel needs. Conventional alloy adding processes such as that disclosed in Guzowski et al U.S. Pat. No. 3,947,265 do not add much, if any, heat to their respective melts. For example, most of the heat generated during melting of the alloy material in Guzowski et al is lost to the atmosphere since the superheated spray is formed entirely above the melt surface.

The spark cup's cylindrical shape also enhances projection of the shielding gas carrying the superheated spray into the melt. Such projection is important in that it enhances dissolution and dispersion of the alloying material into the melt. While a cylindrical shape is preferred, other shapes, such as an inverted frustoconical shape, which provide enhanced projection and heat transfer are considered to be within the purview of the present invention.

The spark cup's composition is another important aspect of the present invention. Preferably, it is made from material having the following characteristics:

1. High radiation heat transfer so as to maximize the transfer of radiation heat from the arc discharge to the melt, thereby reducing the possibility of overheating in the spark cup.

2. High resistance to thermal and mechanical shock.

3. High thermal and chemical stability in the melt. Borosilicate, alumina, mullite and silica are some materials known to possess the desired characteristics.

Figure 4:
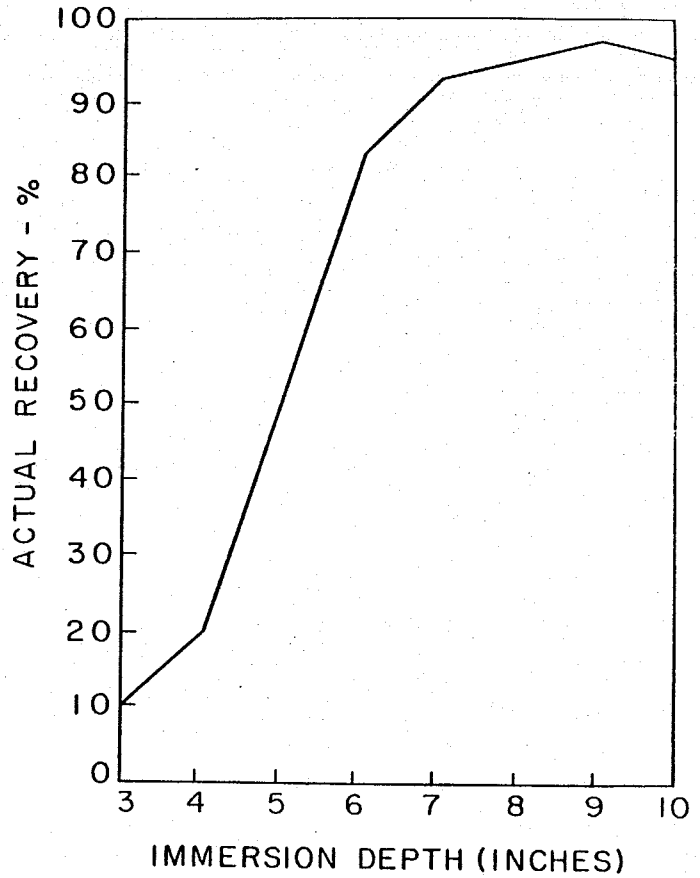
FIG. 4 is a graph illustrating the relationship of actual recovery in percentages versus immersion depth in inches.
Figure 3:
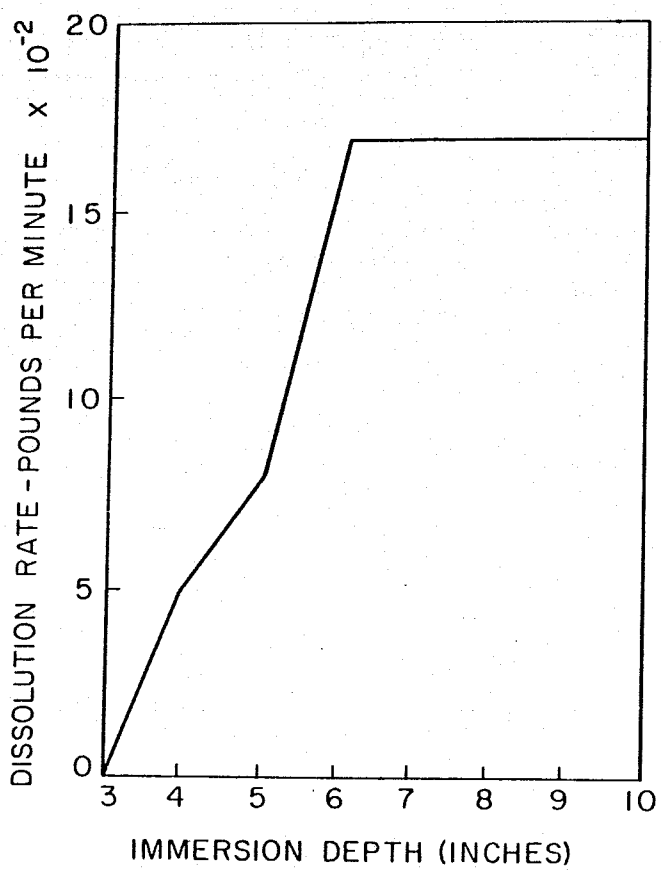
FIG. 3 is a graph plotting alloy dissolution rate in pounds per minute versus spark cup immersion depth.

Another briefly alluded to but important aspect of the present process invention is directed to immersing the spark cup and maintaining submerged surface 26 in the open end of the spark cup at its predetermined depth below exposed surface 16. Such depth will be referred to hereinafter as the predetermined immersion depth. It has been found that a difference of one or two inches in the immersion depth can have a significant impact upon the rate at which alloying material dissolves and disperses in the molten media. FIG. 3 and 4 set forth test data from experiments conducted to determine the effects of immersion depth upon dissolution and dispersion. FIG. 3 sets forth data respecting dissolution rate in pound per minute versus immersion depth, and FIG. 4 shows actual recovery in percentages versus immersion depth. The goal of the experiments was to add 0.5% lead to a substantially lead-free body of molten aluminum. The experiments were conducted with a setup similar to that disclosed in FIG. 1 except that a constant voltage supply source was used instead of the preferred constant current supply source. The flow-through furnace used in the experiments contained approximately 1000 pounds of aluminum. The bath of molten aluminum in the furnace had a depth of approximately 30 inches with a diameter of approximately 23 inches. One-eight inch diameter lead wire was fed into a borosilicate spark cup at a feed rate of about 30 inches per minute via a triplex feed cable. The spark cup was cylindrically shaped and had a lower opening similar to that described in FIG. 1 with a diameter of approximately five centimeters. The spark cup's length to diameter ratio was approximately 6 to 1. Argon shielding gas was fed into the spark cup via the feed cable at a flow rate of about 10 standard $ft^3$/hr. A plasma arc discharge was established in the spark cup between the free end of the lead wire and the submerged molten metal surface at a voltage of about 35 volts and a current of about 125 amperes, which translates into a current density of about 10,000 amp/$in^2$. As such, the free end of the wire melted and converted into an axial spray of superheated allow material upon entering the arc discharge. The spray was directed onto the submerged melt surface by the shielding gas. After adding an appropriate amount of lead wire to the bath of molten aluminum, the alloyed molten aluminum was continuously cast into several ingots having dimensions of 6 in.×6 in.×36 in.

From FIG. 3, those skilled in the art will appreciate that a dramatic increase in lead's dissolution rate (that is, the rate at which lead dissolved into the molten media) resulted when the spark cup immersion depth was increased from five to six inches. It will be noted that further increases in immersion depth did not seem to have much of an effect upon the dissolution rate. Similarly, in FIG. 4, it can be seen that actual recovery in percentages (i.e., the percentage of alloying material added which actually dissolved in the molten media) increased dramatically when the immersion depth was increased from four to six inches. Moreover, further increases in the immersion depth showed further increases in actual recovery; however, not nearly as dramatic as those that occurred from four to six inches. Actual recovery was measured by optical emission spectroscopy. Metallographic examination revealed that the particles of lead in the cast ingot were smaller, more acicular shaped and more uniformly sized and dispersed than those added by conventional methods. Moreover, it is believed that such ingot provided by the present invention has improved machinability.

While the immersion depth providing enhanced dissolution and dispersion in accordance with the present invention will vary with the material being added, bath size, bath flow rate, alloy feed rate and size, inter alia, and will have to be determined for each setup, those skilled in the relevant art will appreciate that the method and apparatus of the present invention can result in greatly increased dissolution rates, particularly for alloy materials with limited solubility, such as lead, bismuth and tin and for high oxidizable materials such as magnesium and zinc. Moreover, it is anticipated that actual recovery (i.e., the percentage of added alloying material which actually dissolves in the molten media being alloyed) should exceed 50% for most alloying materials. In fact, actual recoveries as high as 95%, such as that obtained with lead, should be attainable in most cases.

Those skilled in the art will also appreciate that the present invention is amenable to continuous casting processes. Continuous casting processes are those that permit the continual flow of metal from a melting furnace into a casting mold. Since continuous casting usually proceeds at a uniform rate, it will be easy to calculate the desired alloy feed rate with the method of the present invention. The invention, however, is particularly amenable to continuous casting processes wherein the casting rate varies. Suitable instrumentation can be installed on the casting line to detect any changes in the casting rate which can then be used to make adjustments in the alloy feed rate.

A useful embodiment of the invention concerns the introduction of grain refining additives or grain refiners into molten media, especially molten metal. Grain refiners are normally compounds that are preferably introduced into the molten media in the form of tiny or fine particles widely distributed through the media prior to the solidification or casting operation. It has long been recognized that grain refiners provide discrete nuclei or "seeds" which are very useful in a molten metal or other media that solidifies in crystals or grains or other discrete cells. In the absence of such nuclei, the number of grains or cells is relatively low and their rate of growth is very high so as to produce large prominently nonequiaxed, or columnar, grain structures. Grain refiners, on the other hand, dramatically increase and multiply the nucleation sites and number of grains but reduce the rate of grain or cell growth so as to produce a fine equiaxed grain structure on solidification. It is well recognized that if the grain refiner particles are too large, and their radii too big, the grain refining effect is diminished. Hence, effective grain refiners are preferably tiny nuclei particles, in the micron range, uniformly spread throughout the media.

Master alloys are commonly used as a means to introduce grain refiners into molten metals. Basically, these are dispersions of grains refining particles in a matrix which can be added to a crucible of the molten metal to be grain refined. Master alloy is typically added in the form of pellets but may be provided as rods or other means and as the master alloy melts it freed the grain refining particles. In molten aluminum, titanium aluminide ($TiAl_3$) or titanium diboride ($TiB_2$) have been employed as grain refining nuclei for years. Commercial grain refiner master alloys for aluminum contain 5 to 10% Ti and 0.2 and 0.6% in an aluminum matrix. Said master alloy has been added as pellets or other master alloy forms and has been employed as a consumable rod gradually added to a moving body of molten aluminum.

It is recognized that fine grain refining nuclei do often have a limited life span before either dissolving (and thus disappearing and being ineffective) or before agglomerating to a size so large as to also lose effectiveness. This stability problem related to the useful life or potency of a grain refiner makes it useful to add grain refiners fairly late in the processing of molten metal, such as immediately before casting. However, because commercially available grain refiners contain large nonmetallic particles and other materials that introduce contaminants into the molten metal, there often is a need to filter after grain refiners are added. Also, not all intermetallic particles deposited from commercially available grain refining master alloys or rods are small enough to be effective grain refiners and accordingly, the larger particles need to be filtered out. Fortunately, most filters currently in large scale commercial use do not remove large amounts of fine size grain refining particles but rather remove mostly the excessive size particles.

Thus a problem facing the metal industry, for instance the aluminum metal industry, is that filters are needed to remove excessive size particles introduced in grain refining and with the move to better and better filters there can be a significant amount of good grain refining particles removed thus interfering with grain refining additives introduced prior to such fine filtering. If the grain refiners are introduced after filtering, however, too much contaminants can be introduced into the molten metal so as to impede the purpose served by any filter let alone a high quality fine filter.

Further complicating the operation of grain refining is that the turbulence associated with efficiently introducing and dispersing grain refining additives in molten metal adds oxides and other impurities. Another problem in using master alloys is that such usually requires a substantial volume such as a container or crucible which holds a significant amount of molten metal. The use of large containers for processing steps such as grain refining and clean up steps seriously complicates changing from one alloy to another as is well known. Thus, several operations attendant to grain refining itself introduce adversity into molten metal processing, especially for active metals such as aluminum.

Still a further complicating matter in adding grain refiners to molten aluminum is the use of borides. Borides are generally undesirable in aluminum since they can degrade the metal. To some extent large boride particles are removed by filters but that removal is often sporadic and of limited effectiveness in some filters such as bed particle filters in that borides temporarily removed agglomerate and then reintroduce themselves into the metal in the form of large agglomerates which are even worse than finer boride particles. The borides could be eliminated by use of titanium aluminide as a grain refiner but unfortunately, titanium aluminide alone is not as potent a grain refiner as when boron is present.

The present invention not only solves these problems by introducing either titanium aluminide or titanium diboride or other grain refiner into a molten aluminum body or a suitable grain refiner into other molten media in a controlled, appropriately sized dispersion so as to produce an effective and potent grain refining addition, but the invention facilitates a mode of grain refining wherein a metal element such as titanium can be employed to introduce a grain refiner into another media such as molten aluminum, it being remembered that dissolved titanium itself is not a grain refiner in molten aluminum.

Referring to FIG. 1, grain refiner master alloy rod can be introduced as rod 10. However, in the practice just mentioned, metallic titanium rod 10 is introduced into the chamber 22 where it is converted into a superheated spray, said spray typically including titanium vapor spray and the thus introduced titanium reacts in the molten aluminum to form titanium aluminide ($TiAl_3$) in situ in such a particle pattern as to result in an extremely potent grain refiner, as potent or even more potent than the previously employed titanium diboride. It is believed that the extremely high plasma energy in the chamber vaporizes substantial portions if not all of the titanium such that it forms a vapor spray or other suitable condition or spray that is carried into the molten metal by the gas exiting chamber 22 into the molten media. This provides for an extremely fine and uniform distribution of the titanium in the molten aluminum for prompt reaction therewith to form appropriately sized and potent grain refining nuclei produced as the reaction product between titanium and the molten aluminum. This in situ grain refiner nuclei formation provides for greatly improved efficiencies and economies in grain refining molten aluminum and in grain refining other metals and media as well. For instance, a grain refining arrangement for introducing titanium diboride into a 200,000 pound load of molten aluminum requires about 200 pounds of master alloy containing about 95 percent aluminum and around 4 to 5 percent total of titanium and boride ($TiB_2$) whereas in accordance with the invention employing the chamber arrangement depicted in FIG. 1, a relatively small spool of titanium metal weighing about 10 pounds is all that is needed. Those practicing in the grain refining art will immediately recognize the striking benefit of this change. The fact that the present invention facilitates true grain refining in situ in a moving trough or the like of molten metal will further strike those skilled in the art as a marked improvement and departure from the previous practice. While it is true that $TiB_2$ master alloy rod has previously been introduced in moving bodies of molten aluminum, the amount and weight of materials so introduced complicates material handling and other considerations in the operations which is greatly simplified and streamlined by the practice of the invention involving simply adding a metal or other reactive constituent to the plasma chamber in accordance with the invention and introducing the same as provided for in the invention in the molten media containing another material reactable with the said material so introduced to perform an effective grain refiner in situ. Normally, attempts to introduce titanium rod into molten aluminum simply produces raw undissolved titanium wire or rod in the aluminum with no grain refining being effected. The present invention changes all this in accordance with the particular embodiment just described wherein a constituent is so introduced which is reactable in the media into which it is introduced to provide for the grain refining in accordance with the practice of the invention.

When referring to a constituent herein, such is intended to include an element or metal or ingredient or substance that goes into forming the intermetallic compound. The constituent is typically a metal such as nickel or titanium but could possibly be a compound or other substance including a fluid or gas. When referring to a reactive constituent herein what is intended is that the ingredient or constituent be reactive in practicing the invention. For instance, titanium in the form of a rod is not considered very reactive in molten aluminum at normal aluminum processing temperatures below 1500° F. but it is known that titanium is capable of being reacted with aluminum under certain conditions such as those normally used in forming titanium aluminide. As just stated, simply adding a rod of titanium into molten aluminum is not going to effect this purpose in an efficient manner and certainly not in any effective manner insofar as grain refining is concerned. Nonetheless, in practicing the invention, where the titanium is introduced into the plasma arc and introduced and converted into a vapor or ultrafine spray, it is reactable in molten aluminum. The fine spray or vapor is carried by the gas exiting the chamber 22 such that gas transport is employed as a mechanism to react and distribute the titanium to form an extremely fine distribution of titanium aluminide in situ. It is worth noting in this connection that plasmas typically reach core temperatures in the neighborhood of 50,000° F. whereas titanium vaporizes at around 5,930° F. It is to be appreciated that most metals commonly used in alloying vaporize below 10,000° F. (Cu 4,680°; Ti 5,930°; Zr 7,820°; Nb 8,906°; W 9,986°; Ni 5,135°; Mn 3,704°; Al 4,400°; Cd 2,715°; Cr 4,790°; Co 5,215°; Pb 3,180°; Li 2,426°; Mg 2,040°; Mo 8,720°; Ta 9,800°; Zn 1,665°; Zr 7,910°; Fe 5,225° all degrees F. and approximate). Accordingly, typical plasma core temperatures around 50,000° F. are sufficient to vaporize or finely distribute such metals if this energy is properly harnessed and utilized as in the present invention. Part of this utilization is achieved by using a relatively small chamber such as depicted in FIG. 1 and a carrier gas which can be the ionizable gas, and preferably is the ionizable gas, to utilize the marked efficiencies of gas transport mechanisms which provide for enormous contact surfaces or condensation sites which, in the case of Ti in aluminum, provide for multiplicities of tiny reaction sites to produce multiplicities of tiny nuclei.

In practicing the aspect of the invention involving grain refining, and particularly that involving the introduction of a reactable ingredient or constituent such as titanium into a media such as molten aluminum for reaction therewith or with an ingredient or constituent of the media, the ionizable gas may be argon although helium is preferred because of its higher ionization potential which facilitates transferring more heat into the metal. As stated earlier, grain refiner containing grain refiner particles, for instance the existing 95% Al-5% TiB master alloy, can be used in practicing the invention and such can constitute rod 10 in FIG. 1. It is believed that the invention enables use of a less dilute master alloy to simplify handling problems if desired.

One practice useful in practicing the invention is grain refining is to provide the discharge end of the chamber as a few small holes or openings in the sidewall of chamber 22, a short distance up from the bottom. This allows the molten media to rise inside chamber 22 to the site of the holes providing the discharge end above the bottom of the chamber. These openings and the associated discharge from the chamber 22 are described herein as positioned less deeply in the molten media than the farthest extension of the chamber 22 into the molten media. This discharges some portion or all of the gas from chamber 22 into the media at a site less deep in the media than the farthest extension of chamber 22 into the media and provides a pool of molten media in the chamber beneath the chamber discharge.

In an example in the practice of the invention in grain refining aluminum, molten aluminum made up of 99.9% aluminum was grain refined by introducing a ⅛-inch diameter titanium wire to chamber 22 as shown in FIG. 1 and using helium as the ionizable gas which also served as a carrier gas in that is was applied in sufficient amount as to produce bubbles exiting the outlet of the chamber. It is to be understood in practicing the invention that the ionizable gas is not to be provided in violent or disruptive amounts but rather it is desired that such be introduced in an amount to provide a relatively consistent bubble pattern exiting the chamber or at least in an amount which does not produce violent or agitated conditions at the outlet where it is desired to practice the invention at high efficiency. In this example, helium was introduced at a rate of about 2.7 SCFH per hour and the size of chamber 22 was about 1½ inch in diameter with the outlet immersed in about 6 inches into the molten aluminum. This resulted in achieving a very fine grain size of ASTM grain size 13 which is considered very useful in continuous casting molten aluminum. The grain refining was achieved by in situ forming of $TiAl_3$ and it is to be pointed out that this was accomplished without substantial introduction of massive or non-useful particles sizes of $TiAl_3$ but rather the practice of the invention enabled the formation of $TiAl_3$ in a particle size and distribution which rendered it useful in achieving the aforesaid fine grain size.

While the invention has been described in terms of preferred embodiments, the claims appended hereto are intended to encompass all embodiments which fall within the spirit of the invention.

What is claimed is:

1. A process for adding grain refiner to molten media, comprising the steps of:

(a) providing a chamber having an open discharge positioned within said media;

(b) introducing into said chamber a gas comprising an ionizable gas under sufficient pressure to maintain an interior molten media surface substantially at said chamber's discharge region;

(c) providing a plasma within said chamber, said plasma substantially extending at least from said interior molten media surface to a site within said chamber and spaced from said interior media surface;

(d) supplying to said site within said chamber feed comprising one or more of the group consisting of:

(i) a grain refining material, (ii) two or more materials capable of reacting to form a grain refiner, (iii) a material capable of reacting in said media to produce grain refiner in said media.

and converting said material into superheated array substantially within said plasma and carried toward said interior molten media surface; and (e) conducting gas from said chamber into said media to said entry of said material into said molten media.

2. A process for adding grain refiner to molten media, comprising the steps of:

(a) providing a chamber having an open discharge positioned within said media;

(b) introducing into said chamber a gas comprising an ionizable gas under sufficient pressure to maintain an interior molten media surface substantially at said chamber's discharge region;

(c) providing a plasma within said chamber, said plasma substantially extending at least from said interior molten media surface to a site within said chamber and spaced from said interior media surface;

(d) supplying to said site within said chamber a feed comprising a material capable of reacting in said media or with an ingredient therein to produce a grain refiner in said media and converting said material into superheated spray substantially within said plasma and carried toward said interior molten media surface; and (e) conducting gas from said chamber into said media to aid projection of said material into said molten media so as to enhance entry of said material into said plasma and reaction to produce grain refiner in situ in said media.

3. A process according to claim 1 wherein substantial heat is transmitted into the molten media from the chamber.

4. A process according to claim 1 wherein said chamber is immersed a substantial distance into said molten media such that said grain refiner enters said body at a substantial distance within said body.

5. A process according to claim 1 wherein said gas is substantially introduced at a rate and the chamber means is sized and shapes so as to provide for projection of substances from said chamber into said molten media.

6. A process according to claim 1 wherein said material is supplied to said chamber means as an elongate solid.

7. A process according to claim 1 wherein the length of said chamber along the direction of projection into the molten media exceeds the transverse dimensions of the chamber outlet in the media.

8. A process according to claim 1 wherein said molten media is moving past the discharge of said chamber.

9. A process according to claim 1 wherein the media is agitated to further enhance dispersion within said media.

10. A process according to claim 1 wherein said molten media comprises aluminum or an alloy thereof and said material comprises titanium.

11. A process according to claim 1 wherein said molten media comprises aluminum or an alloy thereof and said material comprises titanium which reacts with aluminum in said media to produce a grain refining substance.

12. A process according to claim 1 wherein said molten media comprises aluminum or an alloy thereof and said material comprises a titanium bearing grain refiner.

13. A process according to claim 1 wherein said molten media comprises aluminum or an alloy thereof and said material comprises a substance that reacts with a constituent in said media to form a grain refining substance.

14. A process according to claim 1 wherein said chamber includes one or more openings at least a portion of which are positioned less deeply in the molten media than the farthest extension of the chamber 22.

15. A process according to claim 1 wherein said two or more materials in said step (d)(ii) are capable of so reacting in one or more of said chamber, plasma and media.

16. A process according to claim 2 wherein said molten media comprises aluminum or an alloy thereof and said chamber includes one or more openings at least a portion of which are positioned less deeply in the molten media than the farthest extension of the chamber 22.

* * * * *

UNITED STATES PATENT AND TRADEMARK OFFICE

CERTIFICATE OF CORRECTION

PATENT NO. : 4,793,971

DATED : December 27, 1988

INVENTOR(S) : Charles E. Eckert and Elwin L. Rooy

It is certified that error appears in the above-identified patent and that said Letters Patent is hereby corrected as shown below:

| | |
|---|---|
| Column 1, line 45 | Change "3947,265" to --3,947,265--. |
| Column 3, line 25 | Change "In spark 22" to -- In spark cup 22 --. |
| Column 7, line 28 | Change "0.6%" to --0.6% B--. |
| Column 9, line 57 | change "Al 4,400°" to -- Al 4,440° --. |
| Column 11, line 52<br>Claim 2 | Change "into said plasma" to --into said media--. |

Signed and Sealed this

Fifteenth Day of August, 1989

*Attest:*

DONALD J. QUIGG

*Attesting Officer*

*Commissioner of Patents and Trademarks*